United States Patent [19]

Muller

[11] 3,938,453

[45] Feb. 17, 1976

[54] APPARATUS FOR ADVANCING THE FEED FRAME OF AN AUTOMATIC EMBROIDERY MACHINE

[75] Inventor: Arno Muller, Meilen, Switzerland

[73] Assignee: Omni Ray AG, Zurich, Switzerland

[22] Filed: July 23, 1974

[21] Appl. No.: 490,964

[30] Foreign Application Priority Data

July 30, 1973 Switzerland ..... 11090/73

[52] U.S. Cl. ..... 112/102; 318/696; 112/90

[51] Int. Cl.[2] ..... D05C 3/02

[58] Field of Search ..... 112/102, 112.12, 86, 90; 318/685, 696

[56] References Cited

UNITED STATES PATENTS

| | | | |
|---|---|---|---|
| 2,833,941 | 5/1958 | Rosenberg et al. | 112/121.12 X |
| 3,128,374 | 4/1964 | Ho et al. | 112/121.12 X |
| 3,146,386 | 8/1964 | Gerber | 318/685 X |
| 3,184,663 | 5/1965 | Mergler | 318/696 X |
| 3,218,533 | 11/1963 | Holthaus et al. | 318/685 X |
| 3,385,244 | 5/1968 | Ramsey et al. | 112/102 X |
| 3,416,056 | 12/1968 | Motooka et al. | 112/121.12 X |
| 3,490,398 | 1/1970 | Anniel | 112/102 |
| 3,752,098 | 8/1973 | Logan et al. | 112/121.12 |
| 3,771,477 | 11/1973 | Conner | 112/121.12 |

*Primary Examiner*—Alfred R. Guest

*Attorney, Agent, or Firm*—Diller, Brown, Ramik & Wight

[57] ABSTRACT

An apparatus for advancing the feed frame of an automatic embroidery machine of the type incorporating two stepping motors which are drivingly connected with the feed or embroidery frame, each stepping motor bringing about a feed or advance of the feed frame in one direction. A control mechanism generates control pulses for each stepping motor as a function of the momentarily required feed displacement of the feed frame in each direction. The control mechanism embodies two switching circuits each of which is operatively associated with one of the stepping motors, and such switching circuits generate output pulses, the number of which is proportional to the number of pulses delivered to each switching circuit by a program storage and by means of which there is determined the magnitude of the momentarily required feed displacement in the corresponding direction.

6 Claims, 1 Drawing Figure

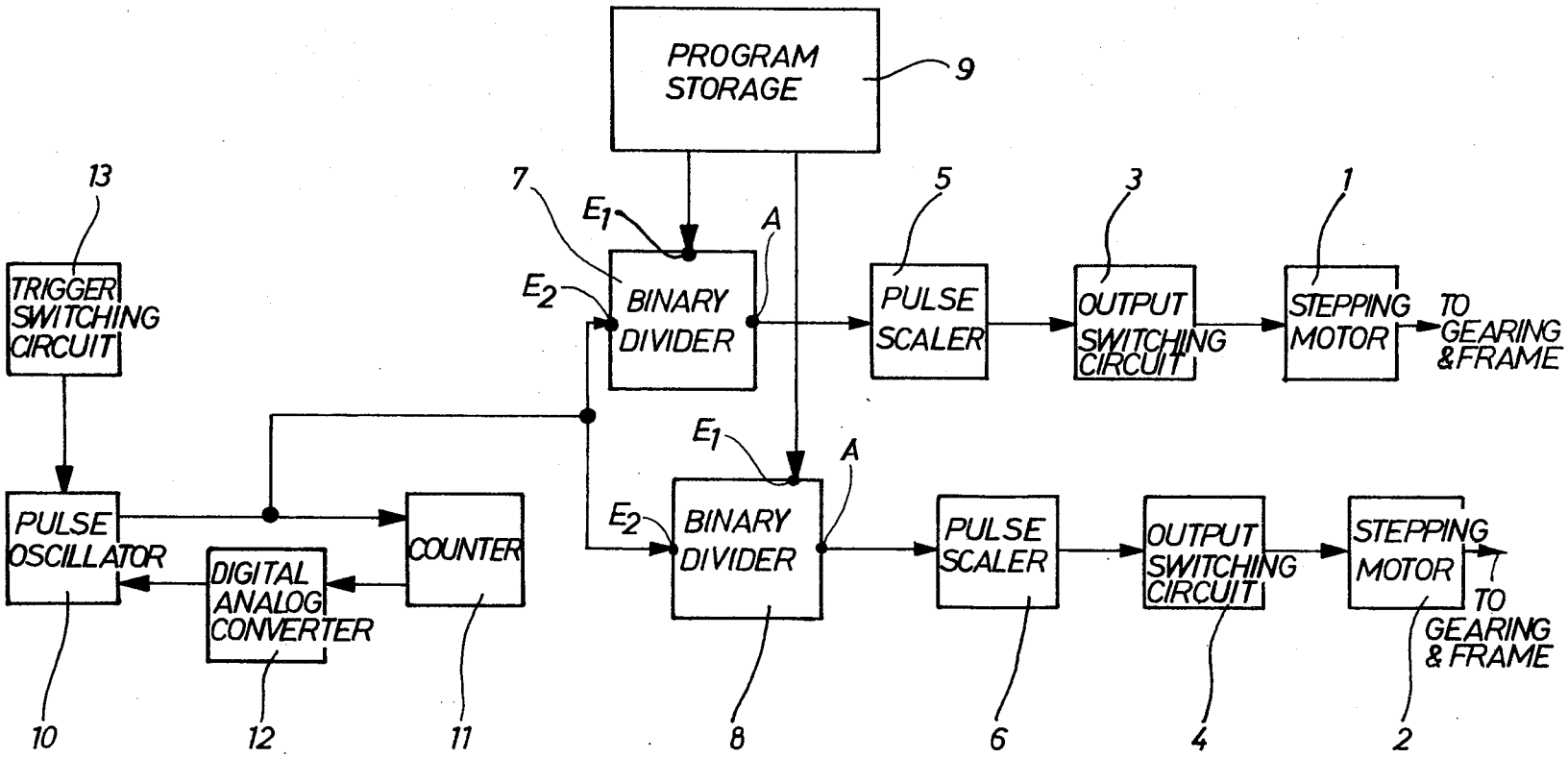
PROGRAM STORAGE
9
BINARY DIVIDER
7
A
E1
E2
PULSE SCALER
5
OUTPUT SWITCHING CIRCUIT
3
STEPPING MOTOR
1
TO GEARING & FRAME
BINARY DIVIDER
8
A
E1
E2
PULSE SCALER
6
OUTPUT SWITCHING CIRCUIT
4
STEPPING MOTOR
2
TO GEARING & FRAME
COUNTER
11
DIGITAL ANALOG CONVERTER
12
PULSE OSCILLATOR
10
TRIGGER SWITCHING CIRCUIT
13

APPARATUS FOR ADVANCING THE FEED FRAME OF AN AUTOMATIC EMBROIDERY MACHINE

BACKGROUND AND SUMMARY OF THE INVENTION

The present invention relates to a new and improved construction of apparatus for feeding or advancing the feed or embroidery frame of an automatic embroidery machine incorporating two stepping motors which are drivingly coupled with embroidery frame, each stepping motor bringing about a feed or advance of the feed frame in one direction, there further being provided a control mechanism which generates control pulses for each stepping motor as a function of the momentarily required feed displacement of the feed frame in each direction.

In automatic embroidery machines of this type the feed or embroidery frame, in which there is clamped the portion of the embroidery material which is to be embroidered, is advanced between two stitching movements of the embroidery needles as a function of the prescribed embroidery pattern. The transport movement of the feed frame is composed of components sub-divided in two directions which normally are designated as the x-direction and the y-direction. The magnitude of such feed components are stored in a program storage, typically for instance a perforated tape.

It is a primary object of the present invention to provide an improved construction of apparatus for advancing the feed or embroidery frame of an automatic embroidery machine in a reliable and positively controlled manner.

Now in order to implement this object, and others which will become more readily apparent as the description proceeds, the previously mentioned apparatus of this development is manifested by the features that the control mechanism comprises two switching circuits operatively associated with the stepping or indexing motors and which switching circuits produce output pulses, the number of which is proportional to the number of pulses delivered to each switching circuit by a program storage and by means of which there is determined the magnitude of the momentarily required feed displacement in the corresponding direction.

BRIEF DESCRIPTION OF THE DRAWINGS

The invention will be better understood and objects other than those set forth above, will become apparent when consideration is given to the following detailed description thereof. Such description makes reference to the annexed drawing wherein the single FIGURE schematically illustrates a block circuit diagram of the control apparatus for the stepping motors for the feed or advancement of the feed or embroidery frame of an automatic embroidery machine as contemplated by the invention.

DETAILED DESCRIPTION OF THE PREFERRED EMBODIMENTS

Describing now the drawings both of the purely schematically illustrated stepping or indexing motors have been designated by reference characters 1 and 2. Each of these stepping motors 1 and 2 drives, through the agency of a suitable and therefore not particularly illustrated coventional transmission or gearing, a likewise not particularly illustrated standard feed or embroidery frame of an automatic embroidery machine in one of two directions, normally disposed at right angles to one another and conveniently designated by reference characters *x* and *y*. Each of the stepping motors 1 and 2 receives its control pulses from an output switching circuit 3 and 4 respectively. The input of each output switching circuit is connected through the agency of a pulse scaling circuit 5 and 6 respectively with the output A of a programable rate multiplier 7 and 8 respectively. Such type circuit can be commercially obtained for instance from the well known United States concern Texas Instruments under their catalog number type Ser. No. 74167.

The one input $E_1$ of each rate multiplier 7 and 8, which can be constituted by a number of terminals, is coupled with the one output of a perforated tape reader 9. This perforated tape reader 9 serves to read a perforated tape (not shown) at which there are stored the values of the desired displacement of the feed or embroidery frame in the x-direction and the y-direction.

The other input $E_2$ of each rate multiplier 7 and 8 is operatively coupled with the output of a pulse oscillator 10 at which there is connected a counter 11. The output of this counter 11 is connected through the agency of a digital-analog converter 12 with an input of the oscillator 10. At a further input of the oscillator 10 there is connected a trigger switching circuit 13 which produces a trigger signal or pulse each time when the embroidery needles have moved out of the portion of the embroidery material which is to be embroidered.

At the output of the perforated tape reader 9 there appear signals which correspond to the *x*- and *y*- components of the feed displacement of the feed or embroidery frame and which are read off the perforated tape. These signals are delivered through the agency of the inputs $E_1$ to the corresponding rate multipliers 7 and 8 respectively. At the other inputs $E_2$ of the rate multipliers 7 and 8 respectively there appear the output pulses of the oscillator 10 which is turned-on by the trigger signals of the trigger switching circuit 13.

The mode of operation of each programable binary divider or rate multiplier 7 and 8 is such that the number of pulses appearing at the output A is equal to the number of pulses applied to the input $E_2$ multiplied by a factor which is proportional to the number of pulses applied to the other input $E_1$.

Since the number of pulses applied to the inputs $E_1$ and emanating from the perforated tape reader 9 corresponds to the momentarily required magnitude of the feed of the feed or embroidery frame in the *x*- and *y*-directions respectively, the number of pulses at the output A of each binary divider or rate multiplier 7 and 8 respectively, is proportional to the magnitude of the *x*- and *y*- components of the displacement.

The output of each rate multiplier 7 and 8 are delivered through the agency of the pulse scaling circuits 5 and 6 respectively to the output switching circuits 3 and 4 respectively.

By carrying out a scaling down operation in the pulse scaling circuits 5 and 6 the pulse sequence produced by the binary dividers or rate multipliers 7 and 8 and having different intervals between successive pulses are converted into a pulse sequence of lesser differing pulse intervals or spacing.

In the output switching circuits 3 and 4 the pulses are transformed and amplified and delivered to the associated stepping motors 1 and 2. The shafts of the stepping motors 1 and 2 rotate by an amount which is proportional to the number of control pulses. The total angle of rotation of each shaft therefore corresponds to the magnitude of the associated component of the feed of the feed frame. The rotation of the stepping motor shafts is transmitted through the agency of the previously mentioned transmission as the feed movements in the $x$- and $y$- directions respectively to the feed or embroidery frame.

The pulses delivered by the oscillator 10 are also delivered to the counter 11 and serve the purpose of resetting such from a predetermined number N back to null. If the counter 11 is reset to null then it generates an output signal which is delivered through the agency of the digital-analog converter 12 to the oscillator 10. By means of this signal the oscillator is turned-off. The oscillator 10 is again turned-on upon the arrival of the next trigger signal from the trigger switching circuit 13.

By means of the digital-analog converter 12 the frequency of the oscillator 10 is influenced at the end of each feed movement in such a way that the feed or embroidery frame is not suddenly, rather gradually braked.

Upon the arrival of a trigger signal the oscillator 10 generates pulses of a predetermined first frequency $f_1$. Then the pulse frequency is continuously increased until reaching a predetermined second frequency $f_2$. Consequently, there is reached the result that the feed frame at the start of each feed movement is not suddenly, rather gradually accelerated.

The start of each feed movement of the feed frame must be matched or accommodated to the stitching movement of the embroidery needles. This is attained by means of the trigger switching circuit 13 which, as already mentioned, always then produces a trigger signal for the oscillator 10 when the embroidery needles depart from the portion of the embroidered material after completion of the embroidering operation.

The time between two successive embroidery stitching movements of the embroidery needles is constant and determined by the drive of the automatic embroidery machine. Optimum conditions can be obtained if the time, during which the feed frame is moved, likewise remains constant independent of the magnitude of the feed movement. Now since the time for the resetting or counting back of the counter 11 from a predetermined number N to null is always the same the switch-in duration of the stepping motors also always remains the same, and specifically independent of the magnitude of the movement of the feed frame determined by the output signal of the perforated tape reader 9.

While there is shown and described present preferred embodiments of the invention, it is to be distinctly understood that the invention is not limited thereto but may be otherwise variously embodied and practiced within the scope of the following claims.

What is claimed is:

1. An apparatus for feeding the embroidery frame of an automatic embroidery machine, comprising two stepping motors drivingly connected with the embroidery frame, each of said stepping motors bringing about a feed of the embroidery frame in one direction, a control mechanism operatively connected with said stepping motors, said control mechanism generating control pulses for each stepping motor as a function of the momentarily required feed displacement of the embroidery frame in each direction, said control mechanism comprising two switching circuits, each switching circuit being operatively connected with one of the stepping motrs, a program storage operatively connected with said switching circuits, said switching circuits generating output pulses, the number of which is proportional to the number of pulses delivered to each switching circuit by said program storage and by means of which there is determined the magnitude of the momentarily required feed displacement in the corresponding direction, said switching circuits comprising programable binary dividers, each binary divider comprising a rate multiplier and having a pair of inputs, a pulse oscillator, one input of each binary divider being operatively coupled with the program storage and the other input with the pulse oscillator, and a trigger switching circuit and a counter, the pulse oscillator being operatively connected with said trigger switching circuit and said counter, said trigger switching circuit generating a trigger signal for turning-on the pulse oscillator and said counter serving to switch-off the pulse oscillator after generating a predetermined number of pulses, and said pulse oscillator generating pulses of a first frequency upon the arrival of the trigger signal and continually increasing the frequency of the generated pulses up to a second value.

2. The apparatus as defined in claim 1, wherein each binary divider has an output, an output switching circuit provided for each binary divider, the output of each binary divider being operatively coupled with an associated one of said output switching circuits which as a function of the number of received pulses delivers control pulses to the associated stepping motor.

3. The apparatus as defined in claim 2, further including a pulse scaling circuit connected in circuit between each binary divider and the associated output switching circuit.

4. An apparatus for feeding the embroidery frame of an automatic embroidery machine, comprising two stepping motors drivingly connected with the embroidery frame, each of said stepping motors bringing about a feed of the embroidery frame in one direction, a control mechanism operatively connected with said stepping motors, said control mechanism generating control pulses for each stepping motor as a function of the momentarily required feed displacement of the embroidery frame in each direction, said control mechanism comprising two switching circuits, each switching circuit being operatively connected with one of the stepping motors, a program storage operatively connected with said switching circuits, said switching circuits generating output pulses, the number of which is proportional to the number of pulses delivered to each switching circuit by said program storage and by means of which there is determined the magnitude of the momentarily required feed displacement in the corresponding direction, said switching circuits comprising programable binary dividers, each binary divider comprising a rate multiplier and having a pair of inputs, a pulse oscillator, one input of each binary divider being operatively coupled with the program storage and the other input with the pulse oscillator, and a trigger switching circuit and a counter, the pulse oscillator being operatively connected with said trigger switching circuit and said counter, said trigger switching circuit generating a trigger signal for turning-on the the pulse oscillator and said counter serving to switch-off the pulse oscillator after generating a predetermined number of pulses, and said counter having an output, a digital-analog converter, said pulse oscillator having an input, the output of the counter being connected with the input of the pulse oscillator through the agency of the digital-analog converter which controls the frequency of the pulse oscillator, the counter after determining the predetermined number of pulses generated by the pulse oscillator producing a switch-off signal.

5. The apparatus as defined in claim 4, wherein each binary divider has an output, an output switching circuit provided for each binary divider, the output of each binary divider being operatively coupled with an associated one of said output switching circuits which as a function of the number of received pulses delivers control pulses to the associated stepping motor.

6. The apparatus as defined in claim 5, further including a pulse scaling circuit connected in circuit between each binary divider and the associated output switching circuit.

* * * * *